United States Patent [19]

Ricketts

[11] Patent Number: 4,737,939

[45] Date of Patent: Apr. 12, 1988

[54] COMPOSITE TRANSDUCER

[75] Inventor: Donald Ricketts, Scituate, Mass.

[73] Assignee: Raytheon Company, Lexington, Mass.

[21] Appl. No.: 38,430

[22] Filed: Apr. 13, 1987

Related U.S. Application Data

[63] Continuation of Ser. No. 818,992, Jan. 13, 1986, abandoned, which is a continuation of Ser. No. 693,228, Jan. 22, 1985, abandoned, which is a continuation of Ser. No. 497,365, May 23, 1983, abandoned.

[51] Int. Cl.[4] ..... H04R 1/00

[52] U.S. Cl. ..... 367/158; 367/165; 310/337; 310/800

[58] Field of Search ..... 310/337, 800; 367/141, 367/153, 155, 157, 158, 165

[56] References Cited

U.S. PATENT DOCUMENTS

| | | | |
|---|---|---|---|
| 3,425,031 | 1/1969 | Klee | 367/903 X |
| 3,716,828 | 2/1973 | Massa | 367/157 |
| 4,191,193 | 3/1980 | Leo | 310/800 |
| 4,354,132 | 10/1982 | Borburgh et al. | 310/800 |
| 4,356,422 | 10/1982 | Van Maanen | 310/800 |
| 4,433,400 | 2/1984 | DeReggi et al. | 367/163 |

OTHER PUBLICATIONS

McGrath et al., Recent Measurements on Improved Thick Film Piezoelectric P Volt Polymer material for Hydrophone Applications IEE Int. Symp. 6/83, pp. 1-8.

*Primary Examiner*—Deborah L. Kyle
*Assistant Examiner*—Brian S. Steinberger
*Attorney, Agent, or Firm*—Martin M. Santa; Richard M. Sharkansky

[57] ABSTRACT

The composite transducer of this invention comprises a prior art longitudinal vibrator-type transducer for transmission of energy and a piezoelectric polymer hydrophone attached to the radiating face of the transducer for the receiving function. During transmission the receiver transducer is short-circuited, and during reception the transmitter transducer is terminated in an electrical impedance that optimizes receiver response and minimizes transducer self-noise. The frequency response of the polymer hydrophone is relatively flat and extends over a much greater frequency range than the transducer.

9 Claims, 2 Drawing Sheets

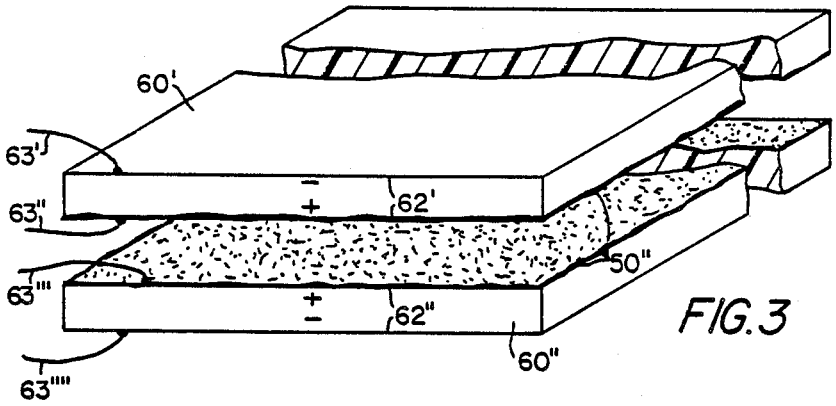
FIG. 3
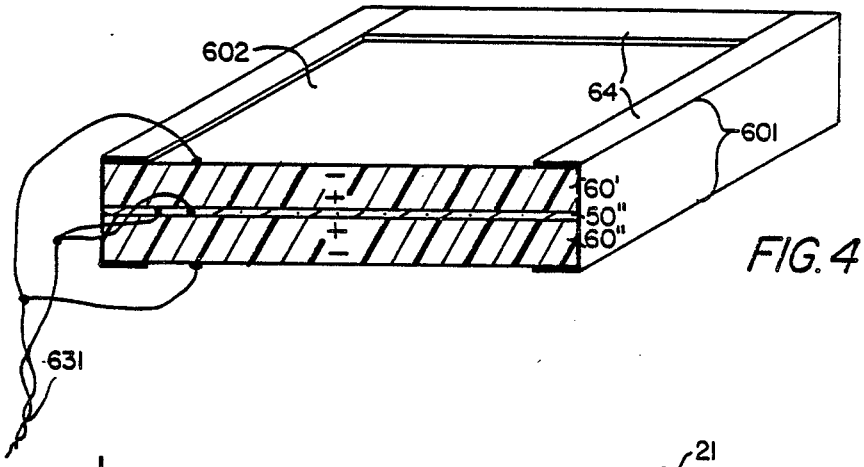
FIG. 4
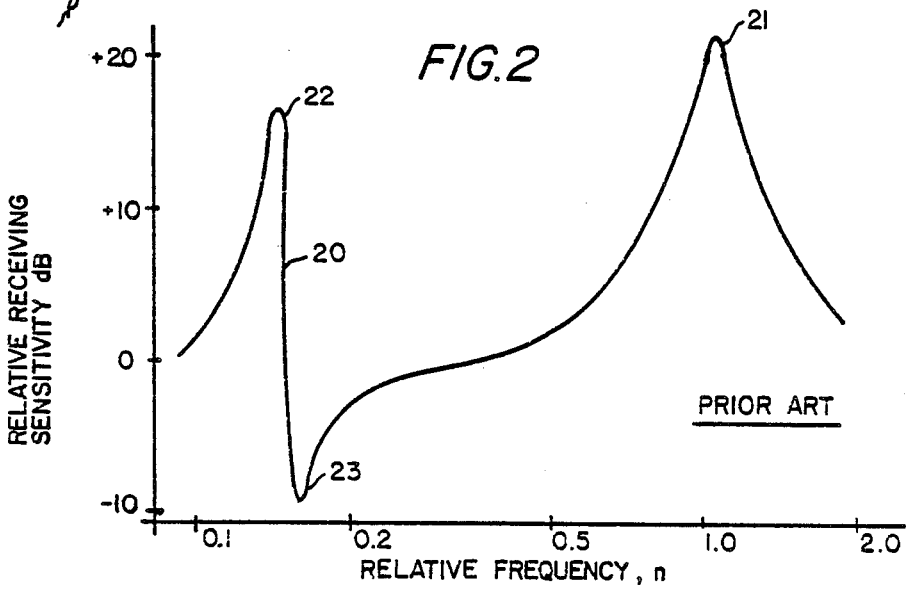

COMPOSITE TRANSDUCER

This application is a continuation of application Ser. No. 818,992 filed 1/13/86 (now abandoned), which is a continuation of application Ser. No. 693,228, filed 1/22/85 (now abandoned), which is a continuation of application Ser. No. 497,365, filed 5/23/83 (now abandoned).

BACKGROUND OF THE INVENTION

This invention relates to transducers, and more particularly to a composite transducer for sonar applications which has separate, non-interfering transmit and receive transducers.

The longitudinal vibrator-type transducer 10 of FIG. 1 is widely used in the prior art as a transmitter and receiver in sonar applications. The transducer consists essentially of an electromechanically active element 11 (typically a piezoelectric ceramic), a head mass 12, a rear mass 13, a bias rod 14, a pressure release system 15 and a waterproof housing 16, as shown in FIG. 1. The bias rod 14 provides a bias compressive stress on both the active element 11 and the pressure release system 15. Acoustic decoupling of the assembly of these components and the housing 16 is provided by the pressure release system 15. There are many variations of the transducer drawn in FIG. 1, but transducers of this general type have two characteristic frequencies that adversely affect receiving response. The two frequencies are the head and tail mount resonances.

Because of the phase shifts associated with resonances and the deterioration of a beam produced by an array of transducers as a consequence of phase shift differences between the transducers, a relatively flat receiving response is desired over a wide bandwidth. However, a typical transducer receiving response has uncontrolled head and tail mount resonances 20 and 21, respectively, as shown in FIG. 2. FIG. 2 shows a plot of receiving sensitivity versus normalized frequency $n=f/f_r$, where $f_r$ is the open-circuit (constant-current) resonant frequency 21. The peak 22 in the response below resonance is due to the head mass-tie rod resonance. Similarly, the response minimum 23 is caused by the resonance of the spring-mass formed by the pressure release pad 15 and the rear mass 13.

In order to achieve a uniform or flat receiving response, the head and tail mount resonance frequencies must be equal, as well as the amplitudes of their resonances. Because of the difficulty of obtaining this balance in high volume production, damping is generally employed to compensate for any unbalance. The damping is often obtained by rubber bumpers 170 that are attached to the rear mass 13 and make frictional contact to the housing 16. A closely balanced transducer requires tight tolerances on both the material parameters and physical dimensions of the transducer. This adds significantly to the cost of the transducer, particularly in high volume production.

In addition to uniformity of receiving sensitivity, transducer self-noise is an extremely important performance parameter. Noisy transducers in a sonar array can cause a degradation of sonar system performance, as well as reveal the presence of the sonar platform. Longitudinal vibrator-type transducers such as that of FIG. 1, in particular have been found to generate extraneous noise when exposed to a changing hydrostatic pressure head. Typically, the extraneous noise is determined by measuring the open-circuit transducer voltage developed during pressure cycling. Polished contacting surfaces of the head mass 12, ceramic 11 and rear mass 13, very close tolerances on machine parts, and well-controlled alignment procedures have been found to be necessary to produce quiet transducers of the longitudinal vibrator type. These noise-quieting features have also added significantly to the cost of the transducer.

Also known in the prior art is a piezoelectric polymer which has low mass density and is mechanically flexible. These properties make the polymer more shock resistant than the prior art piezoceramics. Additionally, the characteristic impedance of the polymer more nearly matches that of water. Piezoelectric polymer film is presently made of polyvinylidene fluoride and is often referred to as $PVF_2$. A polarization procedure must be used to render the polymer usefully piezoelectric. In one method of polarizing, both surfaces of the film are metallized to provide electrodes and a high d-c voltage is applied to the electrodes and held for about one hour at 100° C. Subsequent cooling to room temperature under the applied field results in permanent polarization with the strongest piezoelectric effect in the direction transverse to the metallized surfaces of the film.

The polymer $PVF_2$ has been used previously as a transducer for the transmission and reception of ultrasound signals. Since the acoustic power which may be transmitted with this material is limited, its use has been confined to low power applications such as in medical ultrasound.

SUMMARY OF THE INVENTION

It is therefore an object of this invention to provide a composite transducer which utilizes the prior art longitudinal vibrator-type transducer for the transmitting function, but not for the receiving function, employing instead a separate transducer of piezoelectric polymer type for receiving signals. More particularly, the composite transducer of this invention comprises a prior art longitudinal vibrator-type transducer 10 with a piezoelectric polymer 601 attached to its radiating face 121 for the receiving function as shown in FIG. 1. During transmission the receiver transducer is short-circuited, and during reception the transmitter transducer 10 is terminated in an electrical impedance that optimizes receiver response and minimizes transducer self-noise. The associated switching circuitry for switching between reception and transmission can be internal to the transducer.

It is a feature of the invention that the composite transducer occupies substantially the same space as required by the longitudinal vibrator-type transducer of the prior art, and can be retrofitted into a sonar system without modification of the transducer mounting arrangement.

BRIEF DESCRIPTION OF THE DRAWINGS

The objects and features of this invention are explained in the following description taken in conjuction with the accompanying drawings, in which:

FIG. 2 is a frequency response curve for a longitudinal vibrator-type transducer of the prior art;

FIG. 3 is an isometric exploded view of the $PVF_2$ film; and

FIG. 4 is a cross-sectional isometric view of the assembled $PVF_2$ hydrophone.

DESCRIPTION OF THE PREFERRED EMBODIMENT

Figure 1:
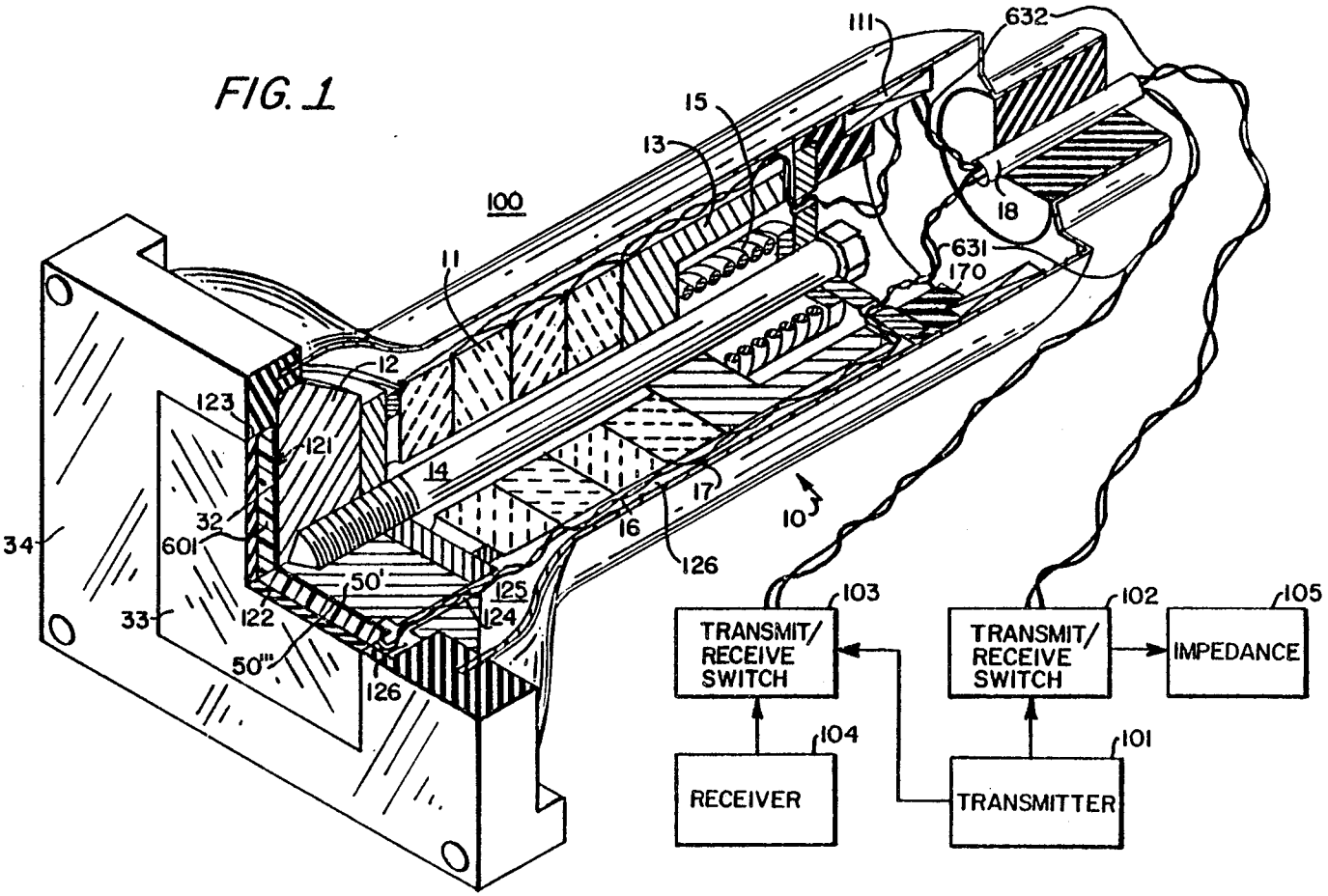
FIG. 1 is an isometric view of the composite transducer of the invention.

The composite transducer 100 of FIG. 1 employs separate elements for the transmission and reception of sound. Transmission is provided by applying an electrical voltage from transmitter 101 through a transmit/-receive (T/R) switch 102 to a piezoelectric ceramic 11. A transformer 111 is used to impedance match the ceramic 11 to the transmitter 101. During the time that transmitter 101 is providing power to ceramic 11, the transmit/receive (T/R) switch 103 is providing a short circuit across lines 631, connected to the polymer assembly 601. At the termination of transmitter power, T/R switch 103 connects the receiver 104 across polymer assembly 601 and T/R switch 102 connects an impedance 105 across lines 632 to thereby terminate ceramic 11.

The composite transducer 100 transmitter portion is the well-known longitudinal electro-mechanical vibrator-type 10 which in the prior art is used for both transmitting and receiving. However, in this invention the receiving transducer (hydrophone) is a layer of thick film piezoelectric polymer 601, polyvinylidene fluoride ($PVF_2$), used in a modified hydrostatic mode. In a hydrostatic mode, the acoustic pressure acts equally in all three axes so there is no need for a pressure release mechanism and associated housing for decoupling one side of the sensing element from the sound field. In the hydrostatic mode, there is an absence of pressure differential across the hydrophone, resulting in virtually unlimited operating pressure capability. In this invention, there is modified hydrostatic operation since one surface of the polymer is in direct contact with the radiating face 121 of the transducer 10, and hence, not exposed to the water pressure. Because $PVF_2$ closely matches the impedance of water, the transmitted sound from transducer 10 will pass through the $PVF_2$ sheet 601 with negligible attenuation. During transmission, the hydrophone 601 is short-circuited. The polymer hydrophone 601 attached to the radiating face 121 of transducer 10 does not adversely affect its transmission properties. During reception, the transducer 10 is preferably terminated in an impedance which minimizes the noise in the hydrophone 601 signal or transducer 10 may be short-circuited with no loss of received signal-to-noise ratio. Moreover, the useful receiving response of the hydrophone 601 extends up to 100 KHz. Measured polymer hydrophone response for the open-circuit and short-circuit transducer 10 conditions indicates that the short-circuit condition yields the more uniform response essentially flat from 10 KHz to 100 KHz. Greater uniformity is expected, especially below 10 KHz, for the optimum termination of transducer 10.

Velocity control, noise cancellation, and intercept receivers, among other uses, are potential applications for this invention.

The measured directivity pattern of the 4×4 inch sheet of $PVF_2$ hydrophone 601 at 100 KHz had a 3 db beamwidth of approximately 4.5° which is indicative of the excellent beam pattern available from polymer hydrophones at high frequencies. The results of high power transmission tests from transducer 10 indicate that exposure to high intensity sound fields has no measurable effect on the polymer hydrophone performance properties. In addition, exposure to hydrostatic pressure cycling during noise testing did not adversely affect the polymer hydrophone.

The fabrication of the composite transducer 100 of FIG. 1 is accomplished by removing a square of the vulcanized rubber 34 which is adjacent the face 121 of the head mass 12 of the prior art transducer 10 in order to expose the aluminum head mass 12. An isometric cross-sectional view of the face 121 is shown in FIG. 1 where the square pocket 123 produced by removing rubber 34 extends over a substantial portion of the rectangular face 121. In order to obtain a flat, smooth surface on face 121, the face was machined and a few thousandths of the face removed. A hole 124 was drilled through head mass 12 from face 121 to an interior space 125 within housing 16 of the transducer 10. A rectangular channel 126 was machined into face 121 at the location of the hole 124. The exposed surface of the face 121 was grit-blasted as was the mating surface of a sheet of glass-fiber, epoxy-impregnated, electrical insulating mat 32. A suitable mat, commercially available, is known as G-10 mat. The mat 32 and face 121 were bonded to each other by an epox 50' under heat and pressure to exclude trapped air and to provide a rigid bond.

The piezoelectric polymer $PVF_2$ assembly 601 was assembled of two $PVF_2$ films 60', 60'', each being 4×4×0.023 inches, with opposed faces covered with epoxy 50'', as shown in FIG. 3. For a 0.023 inch thickness $PVF_2$ layer, the thickness expressed in wavelengths is substantially 0.03 wavelengths at the highest illustrative operating frequency of 100 KHz since the velocity of sound in the $PVF_2$ is well known to be in the range of 900–1800 meters/second. Each film 60 has a metallic coating 62 on both sides of the sheet to which wires 63 are electrically connected by vacuum welding or by low temperature soldering. Typically, the metallic coating 62 is copper and the wire 63 is a Kovar ribbon, 0.003×0.010 inches. Other metallic materials would be satisfactory for each provided electrical connection can be made between the selected coating and wire materials at a temperature which is nondestructive to the $PVF_2$. Using suitable fixturing, the $PVF_2$ films 60 were bonded together by the epoxy 50'' and air cured to form the $PVF_2$ polymer assembly 601 as shown in FIG. 4.

The attachment of the $PVF_2$ assembly 601 to the glass fiber mat 32 is the next step in the fabrication of the composite transducer. To prevent the $PVF_2$ assembly from electrically shorting to the face 121 or to the wires 63, electrical-insulating tape 64 was attached to the four edges of the $PVF_2$ square as shown in FIG. 4. The wires 63 were also covered with a lightweight polyolefin shrink sleeving material. The exposed face of fiberglass mat 32 was roughened to remove shiny glaze and cleaned by air dusting. The surface 602 of $PVF_2$ assembly 601 was cleaned by wiping with methylethylketone (MEK) which did not adversely affect the copper surface 62 of the $PVF_2$.

The mat 32 and the PVF2 assembly 601 surface 602 were coated with epoxy 50''' and placed in contact with each other to air cure with the insulated wires 63 folded in the channel 126 and threaded through the head mass hole 124 as shown in FIG. 1. Channel 126 allows the $PVF_2$ assembly 601 to lay flat against the face 121 by providing space for the connecting wires 63.

The final steps in the assembly of the composite transducer 100 of FIG. 1 comprise cleaning the outermost surface of the $PVF_2$ assembly 601 with MEK, coating with liquid neoprene, and air drying. A square of rubber 33, substantially of the thickness and area of the remaining depth of the pocket 123 and the exterior surface of the $PVF_2$, are coated with neoprene and bonded to each other by air curing. The resulting exterior surface of the rubber 33 and rubber head mass cover 34 are machine-ground to provide a flat exterior surface.

The wires 63 pass through the space 125 between the transducer shroud 17 and the head mass 12, ceramic 11, and rear mass 13 to the cable 18. Cable 18 is a four-conductor cable containing also the two conductors 632 to the transducer ceramic 11 from the transmitter 101 located at some remote location. A receiver preamplifier (not shown) may be contained within the composite transducer 10 to amplify the signal prior to connection to the two wires of cable 18 which are connected to a receiver.

The $PVF_2$ material 601 has an internal polarization when used as a piezoelectric element. The polarization is represented by the voltage polarity designations of the $PVF_2$ shown in FIG. 3. A parallel connection is obtained by connecting wire 63' to wire 63'''', and wire 63'' to wire 63''', as shown in FIG. 4, to thereby provide one pair of wires 631 to which the receiver is connected. The parallel connection doubles the capacitance provided by each $PVF_2$ sheet 60 and thereby provides a better impedance match to the cable. If a preamplifier is used within the transducer 11, the capacitance of the $PVF_2$ assembly 601 is of less importance. The thickness of each of the $PVF_2$ sheets, the number of sheets, and their serial/parallel electrical interconnection are design choices.

Modifications of the preferred embodiment will be apparent to those skilled in the art. For example, the copper electrode on both sides of each $PVF_2$ sheet could be removed at its edges by etching or some other suitable technique. This would eliminate possible short circuits between the $PVF_2$ assembly and the connecting wires, thereby eliminating the need for taping. The use of a heavier copper wire may replace the relatively fragile Kovar material of the preferred embodiment. Also, an electrically conductive epoxy might be used for fastening wires 63 to the $PVF_2$ metallic film 62 instead of welding or soldering.

Having described a preferred embodiment of the invention, it will now be apparent to one of skill in the art that other embodiments incorporating its concept, may be used. It is felt, therefore, that this invention should not be restricted to the disclosed embodiment, but rather should be limited only by the spirit and scope of the appended claims.

What is claimed is:

1. A composite transducer for operation in the less than 100 kilocycle range comprising:

a longitudinal vibrator-type transmitter transducer having a transmitting head mass and face;

a rear mass;

a stack of piezoelectric ceramic elements between said head and rear masses for electrically producing vibration of said head face;

a piezoelectric polymer layer receiver hydrophone which is acoustically transparent at the frequency of operation of said transducer attached to and covering a substantial portion of said head face;

means for detecting the electrical potential produced in said polymer hydrophone; and means terminating said pizeoelectric ceramic elements in an electrical impedance that improves said receiver hydrophone response and reduces said transmitter transducer self-noise.

2. The transducer of claim 1 wherein said polymer hydrophone is a layer of $PVF_2$.

3. The composite transducer of claim 1 wherein said electrical impedance is a short circuit.

4. A composite transducer for operation in the less than 100 kilocycle range comprising:

a longitudinal vibrator-type transmitter transducer having a head mass, said head mass having an exterior face;

a rear mass;

a stack of piezoelectric ceramic elements between said head and rear masses for electrically producing vibration of said head mass;

a piezoelectric polymer layer having two sides, both of which are metallized, one of said sides being bonded to said face;

said polymer layer being acoustically transparent at a frequency of operation of said transducer;

means for making electrical connection to said metallized sides of said layer;

means for covering said polymer layer and said transducer to electrically insulate and waterproof said layer and said transducer; and means terminating said piezoelectric ceramic elements in an electrical impedance that improves said polymer layer response and reduces said transmitter transducer self-noise.

5. The transducer of claim 4 wherein said piezoelectric polymer layer is $PVF_2$.

6. The transducer of claim 4 wherein said piezoelectric polymer layer has a characteristic impedance substantially equal to the characteristic impedance of water.

7. The transducer of claim 4 wherein said polymer layer comprises a plurality of metallized polymer films, the metallized films being electrically connected to provide an electrical interconnection of said films.

8. The transducer of claim 4 wherein said polymer layer comprises at least two films, each film having a polarization transverse to said sides, and having metallized layers on both sides of each film, the metallized layers adjacent the same polarization of each film being electrically connected.

9. The composite transducer of claim 4 wherein said electrical impedance is a short circuit.

* * * * *

UNITED STATES PATENT AND TRADEMARK OFFICE

CERTIFICATE OF CORRECTION

PATENT NO. : 4,737,939

DATED : April 12, 1988

INVENTOR(S) : Donald Ricketts

It is certified that error appears in the above-identified patent and that said Letters Patent is hereby corrected as shown below:

Column 4, line 22, delete "epox" and replace with -- epoxy --.

Column 6, line 10, delete "pizeoelectric" and replace with -- piezoelectric --.

Signed and Sealed this

Fourteenth Day of November, 1989

*Attest:*

JEFFREY M. SAMUELS

*Attesting Officer*

*Acting Commissioner of Patents and Trademarks*